US005206581A

United States Patent [19]

Yoshida

[11] Patent Number: 5,206,581

[45] Date of Patent: Apr. 27, 1993

[54] CONSTANT VOLTAGE CIRCUIT

[75] Inventor: Yoshihiro Yoshida, Yokohama, Japan

[73] Assignee: Kabushiki Kaisha Toshiba, Kawasaki, Japan

[21] Appl. No.: 803,892

[22] Filed: Dec. 9, 1991

Related U.S. Application Data

[63] Continuation of Ser. No. 606,831, Oct. 31, 1990, abandoned.

[30] Foreign Application Priority Data

Nov. 2, 1989 [JP] Japan ..... 1-284976

[51] Int. Cl.[5] ..... G05F 3/30

[52] U.S. Cl. ..... 323/313; 323/314; 307/296.1; 307/296.6

[58] Field of Search ..... 323/312, 313, 314; 307/296.1, 296.6, 296.7

[56] References Cited

U.S. PATENT DOCUMENTS 3,617,859 11/1971 Dobkin et al. .
3,893,018 7/1975 Marley .
4,059,793 11/1977 Ahmed ..... 323/313
4,644,257 2/1987 Bohme et al. .

FOREIGN PATENT DOCUMENTS 0116995 8/1984 European Pat. Off. .
3321556 12/1984 Fed. Rep. of Germany .
2255652 7/1975 France .
61-125622 6/1986 Japan .

OTHER PUBLICATIONS

Japanese Utility Model Publication (Kokai) No. 64-21418 (Z. Zoshida); Feb. 2, 1989, pp. 35-37.

*Primary Examiner*—Emanuel T. Voeltz
*Attorney, Agent, or Firm*—Banner, Birch, McKie & Beckett

[57] ABSTRACT

In a constant voltage circuit, when a second resistor element is inserted between the base and collector of a first transistor and between the other terminal of a first resistor element and the base of a second transistor, a basic equation for calculating a bandgap voltage reference can be calculated free from a base-emitter voltage of the third transistor. Therefore, since a change in base-emitter voltage on the basis of a change in current flowing through the third transistor does not appear as an output voltage, the output voltage can be stabilized.

7 Claims, 6 Drawing Sheets

CONSTANT VOLTAGE CIRCUIT

This application is a continuation of application Ser. No. 07/606,831, filed Oct. 31, 1990, now abandoned.

BACKGROUND OF THE INVENTION

1. Field of the Invention

The present invention relates to a constant voltage circuit for generating a constant reference voltage using a base-emitter voltage and a $V_T$ voltage.

2. Description of the Related Art

Conventionally, as a constant voltage circuit capable of setting a temperature coefficient to be 0 or an arbitrary value, a circuit disclosed in the U.S. Pat. No. 3,617,859 is well known. As shown in FIG. 1, the constant voltage circuit consists of a current source 41, three resistors 42, 43, and 44, and three npn transistors 45, 46, and 47. For example, an emitter area of the transistor 46 is N times that of the transistor 45 such that the transistor 45 and 46 have different current densities. A positive input voltage $V_{IN}$ and a ground voltage GND are applied to nodes 48 and 49, respectively, and an output voltage $V_{OUT}$ is obtained from an output node 50.

In the conventional circuit, assuming that base-emitter voltages of the transistors 45, 46, and 47 are set to be values $V_{BE1}$, $V_{BE2}$, and $V_{BE3}$; resistors 42, 43, and 44 are set to have values $R_1$, $R_2$, and $R_3$; currents flowing through the resistors 42 and 43 are set to be $I_1$ and $I_2$; and a collector current of the transistor 47 is set to be $I_3$, the base-emitter voltage $V_{BE1}$ is obtained by the following equation (1)

$$V_{BE1}=V_{BE2}+I_2 \cdot R_3 \quad (1)$$

A voltage VOUT obtained from the output node 50 is given by:

$$\begin{aligned} V_{OUT} &= I_1 \cdot R_1 + V_{BE1} \\ &= I_2 \cdot R_2 + V_{BE3} \end{aligned} \quad (2)$$

The base-emitter voltages $V_{BE1}$, $V_{BE2}$, and $V_{BE3}$ of the transistors 45, 46, and 47 are expressed by the following equations:

$$V_{BE1}=V_T ln(I_1/I_s) \quad (3)$$

$$V_{BE2}=V_T ln\{I_2/(N.I_5)\} \quad (4)$$

$$V_{BE3}=V_T ln(I_3/I_s) \quad (5)$$

where Is is a saturation current. Assuming that $V_{BE1}=-V_{BE3}$, the following equation can be obtained by the equation (2).

$$I_1 \cdot R_1=I_2 \cdot R_2 \quad (6)$$

The following equation can be obtained by the equations (1), (3), and (4):

$$V_T ln(I_1 \cdot N/I_2)=I_2 \cdot R_3 \quad (7)$$

When the equation (6) is substituted into the equation (7), the following equation can be obtained:

$$V_T \ln (R_2 \cdot N/R_1)=I_2 \cdot R_3 \quad (8)$$

When the equation (8) is substituted into the equation (2), the following equation can be obtained:

$$V_{OUT}=(R_2/R_3) \cdot V_T ln(R_2 \cdot N/R_1)+V_{BE3} \quad (9)$$

The equation (9) is well known as a basic equation of a bandgap voltage reference. The value $V_T$ in the equation (9) is given as a value kT/q (where: k is the Boltzman's constant; T, absolute temperature: and q, an electron charge) and has a positive temperature coefficient. Contrast to this, since the base-emitter voltage $V_{BE3}$ of the transistor 47 has a negative temperature coefficient, the resistances $R_2$ and $R_3$ of the resistors 43 and 44 are adjusted so that the temperature coefficient of the output voltage $V_{OUT}$ can be set to be 0 or an arbitrary value.

Stability of the output voltage in the conventional circuit will be described below. FIG. 3 is a graph showing variation characteristics of the output voltage $V_{OUT}$ obtained by performing SPICE analysis when a value I of a current source is changed in a conventional circuit with the arrangement in FIG. 2. As shown in FIG. 2, the resistors 42, 43, and 44 are respectively set to be 22 KΩ, 22 KΩ, and 1.8 KΩ, an emitter area ratio N of the transistor 45 to the transistor 46 is set to be 4. As is apparent from FIG. 3, when the current value is changed from 10 μA to 30 μA, an output voltage difference in the conventional circuit is 60.2 mV.

As described above, since a change in current flowing through the above conventional circuit, especially, a change in the collector current of the transistor 47 on the basis of a change in output value of the current source is not considered, the output voltage is largely changed by the change in the collector current.

SUMMARY OF THE INVENTION

The present invention is made in consideration of the above conditions, and has as its object to provide a constant voltage circuit which is stable for a change in current.

According to the present invention, there is provided a constant voltage circuit comprising a control circuit having input and output terminals in which an output is controlled according to a current flowing through the input terminal, a first resistor element one terminal of which is connected to the output terminal of the control circuit, a second resistor element one terminal of which is connected to other terminal of the first resistor element, a first transistor of a first polarity a base of which is connected to the other terminal of the first resistor element, a collector of which is connected to other terminal of the second resistor element, and an emitter of which is connected to a first node, a third resistor element one terminal of which is connected to the output terminal of the control circuit, a second transistor of a first polarity a collector of which is connected to other terminal of the third resistor element, a base of which is connected to the other terminal of the second resistor element, and an emitter of which is connected to the first node, and a third transistor of the first polarity a collector of which is connected to the input terminal of the control circuit, a base of which is connected to the other terminal of the third resistor element, and an emitter of which is connected to the first node, wherein currents flowing through the first and second transistors have different current densities.

According to the present invention, there is provided a constant voltage circuit comprising a control circuit having an input terminal and first and second output terminals in which outputs from the first and second output terminals are controlled according to a current flowing through the input terminal, a first resistor element one terminal of which is connected to the first output terminal of the control circuit, a second resistor element one terminal of which is connected to the other terminal of the first resistor element, a first transistor of a first polarity a base of which is connected to the other terminal of the first resistor element, a collector of which is connected to other terminal of the second resistor element, and an emitter of which is connected to a first node, a third resistor element one terminal of which is connected to the second output terminal of the control circuit, a second transistor of the first polarity a collector of which is connected to other terminal of the third resistor element, a base of which is connected to the other terminal of the second resistor element, and an emitter of which is connected to the first node, and a third transistor of the first polarity a collector of which is connected to the input terminal of the control circuit, a base of which is connected to the other terminal of the third resistor element, and an emitter of which is connected to the first node, wherein currents flowing through the first and second transistors have different current densities.

In a constant voltage circuit according to the present invention, the second resistor element is inserted between the base and collector of the first transistor and between the other terminal of the first resistor element and the base of the second transistor, a basic equation for calculating a bandgap voltage reference can be free from a base-emitter voltage of the third transistor. Therefore, since a change in base-emitter voltage on the basis of a change in current flowing through the third transistor does not appear as an output voltage, the output voltage can be stabilized.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

A constant voltage circuit according to embodiments of the present invention will be described below with reference to the accompanying drawings.

Figure 4:
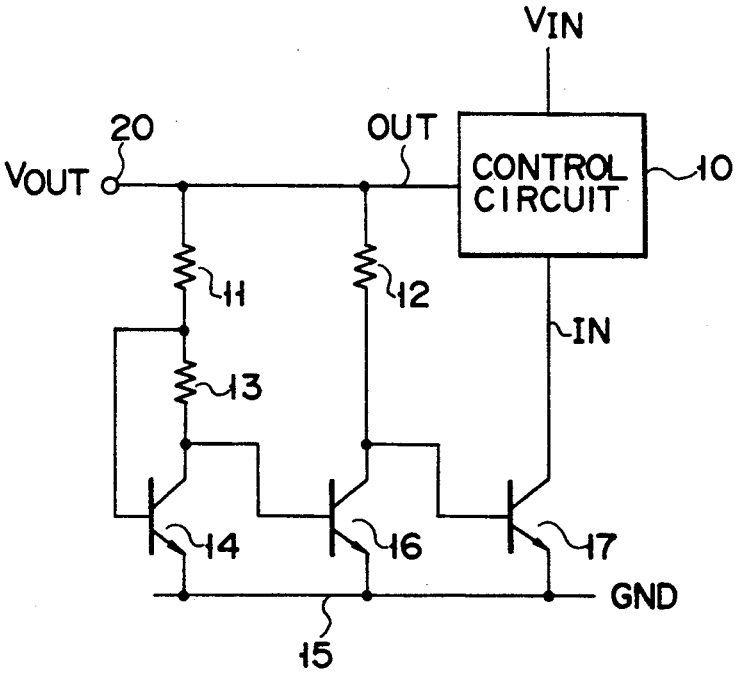
FIG. 4 is a circuit diagram showing a basic circuit arrangement of the constant voltage circuit of the present invention.

FIG. 4 is a circuit diagram showing a basic circuit arrangement of a constant voltage circuit according to the present invention. Reference numeral 10 denotes a control circuit to which an input voltage $V_{IN}$ is supplied, which has an input terminal IN and an output terminal OUT, and which outputs, from an output terminal OUT, a current or voltage having a value corresponding to a current flowing through the input terminal IN. That is, in the control circuit 10, the output is controlled depending on the value of the input current. One terminal of a resistor 11 and one terminal of a resistor 12 are connected to the output terminal OUT of the control circuit 10. One terminal of a resistor 13 and the base of an npn transistor 14 are connected to the other terminal of the resistor 11. The other terminal of the resistor 13 is connected to the collector of the transistor 14. The emitter of the transistor 14 is connected to a node 15 to which a ground potential GND is applied. The other terminal of the resistor 12 is connected to the collector of an npn transistor 16. The base of the transistor 16 is connected to the other terminal of the resistor 13, and the emitter of the transistor 16 is connected to the node 15. The collector of npn transistor 17 is connected to the input terminal IN of the control circuit 10. The base of the transistor 17 is connected to the other terminal of the resistor 12, and the emitter of the transistor 17 is connected to the node 15. The output voltage $V_{OUT}$ is obtained from an output node 20 to which the output terminal OUT of the control circuit 10 is connected. In addition, in order to adjust a value ln obtained by the later equation (15), the following methods are employed. Both the transistors 14 and 16 have different emitter areas to cause the transistors 14 and 16 to have different current densities, and/or the resistors 11 and 12 have different resistances.

In the constant voltage circuit of the present invention, the resistor 13 which is conventionally inserted to the emitter side of the transistor 16 is inserted to the collector side of the transistor 14.

Various embodiments of the present invention will be described below.

Figure 5:
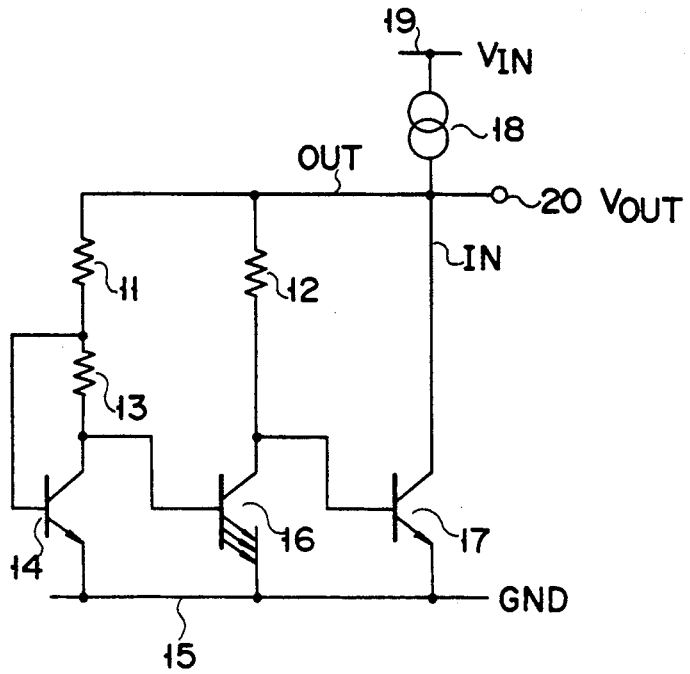
FIGS. 5 to 8 are circuit diagrams showing arrangements of constant voltage circuits according to the first to fourth embodiments of the present invention, respectively.

FIG. 5 is a circuit diagram showing an arrangement according to the first embodiment of the present invention. In the first embodiment, a constant current source 18 having a terminal commonly used as input and output terminals IN and OUT is used as a control circuit 10. Other arrangements of this embodiment are the same as those in FIG. 4. That is, in the first embodiment, one terminal of the constant current source 18 used as the control circuit 10 is connected to an input node 19 applied with a positive input voltage $V_{IN}$, and the other terminal is connected to an output node 20 for obtaining an output voltage $V_{OUT}$. In the first embodiment, in order to cause the currents flowing through the transistors 14 and 16 to have different current densities, the emitter area of the transistor 16 is N times that of the transistor 14.

According to the first embodiment, in the constant current source 18 used as the control circuit 10, when a collector current of the transistor 17 serving as an input current is changed, a sum of the currents flowing through the resistors 12 and 13 and serving as output currents is also changed.

In the first embodiment, as in a conventional technique, assuming that base-emitter voltages of the transistors 14, 16, and 17 are set to be values $V_{BE1}$, $V_{BE2}$, and $V_{BE3}$; transistors 11, 12, and 13 are set to have resistance values $R_1$, $R_2$, and $R_3$; currents flowing through the resistors 11 and 12 are set to be $I_1$ and $I_2$; and the collector current of the transistor 17 is set to be $I_3$, the base-emitter voltage $V_{BE1}$ is obtained by the following equation (10):

$$V_{BE1}=V_{BE2}+I_1\cdot R_3 \tag{10}$$

A voltage $V_{OUT}$ obtained from the output node 20 is given by:

$$\begin{aligned} V_{OUT} &= I_1\cdot R_1 + V_{BE1} \\ &= I_2\cdot R_2 + V_{BE3} \end{aligned} \tag{11}$$

In this case, base-emitter voltages of the transistors 14, 16, and 17 are expressed as in the above equations (3), (4), and (5).

Assuming that $V_{BE1}=V_{BE3}$, the following equation can be obtained by the equation (11):

$$I_1\cdot R_1=I_2\cdot R_2 \tag{12}$$

and the following equation can be obtained by the equations (10), (3), and (4).

$$V_T ln(I_1\cdot N/I_2)=I_1\cdot R_3 \tag{13}$$

In addition, the equation (12) is substituted into the equation (13) to obtain the following equation:

$$V_T ln(R_2\cdot N/R_1)=I_1\cdot R_3 \tag{14}$$

When the equation (14) is substituted into the equation (11), the following equation can be obtained:

$$V_{OUT}=(R_1/R_3)\cdot V_T ln(R_2\cdot N/R_1)+V_{BE1} \tag{15}$$

In this case, when the equation (15) is compared with the equation (9), $R_2/R_3$ is changed to $R_1/R_3$, and $V_{BE3}$ is changed to $V_{BE1}$. The first term of the right-hand side has a positive temperature coefficient, and the second term has a negative temperature coefficient. Therefore, in the first embodiment, the resistances $R_1$ and $R_3$ are adjusted to set the temperature coefficients to be to 0 or arbitrary values as in the conventional circuit.

In the first embodiment, it is assumed that, when a load circuit is connected to the output node 20, a load current is changed to change the collector current of the transistor 17. A change in load current appears as a change in collector current of the transistor 17. For this reason, when the voltage $V_{OUT}$ obtained from the output node 20 is partially differentiated with the current $I_3$, the following equation can be obtained as a result:

$$\frac{\partial V_{OUT}}{\partial I_3}=\frac{V_T}{I_3}\cdot\frac{1}{1-\left(1-\ln N\frac{I_1}{I_2}\right)\frac{I_2\cdot R_2}{(I_1\cdot R_1+V_T)}} \tag{16}$$

On the other hand, when the same calculation as described above is performed in the conventional circuit, the following equation can be obtained:

$$\frac{\partial V_{OUT}}{\partial I_3}=\frac{V_T}{I_3}\cdot\frac{1}{1-\frac{I_2\cdot R_2}{(I_1\cdot R_1+V_T)\cdot\left(1+\ln N\frac{I_1}{I_2}\right)}} \tag{17}$$

In this case, as the value of $\partial V_{OUT}/\partial I_3$ is reduced, the value of the voltage $V_{OUT}$ is stabilized. Therefore, it is preferable that denominators of the right-hand sides of the equations (16) and (17) have larger values. When different terms in the denominators of both the equations (16) and (17) are compared with each other to examine which part has a large value, it is known which denominator of the right-hand side of the equation (16) or (17) has a larger value. That is, $1-\ln N\cdot I_1/I_2$ in the equation (16) is compared with $1/(1+\ln N\cdot I_1/I_2)$ in the equation (17). When $1-\ln N\cdot I_1/I_2$ is subtracted from $1/[1+(\ln N\cdot I_1/I_2)]$, the following equation can be obtained:

$$\frac{1}{1+\ln N\frac{I_1}{I_2}}-\left(1-\ln N\frac{I_1}{I_2}\right)=\frac{\left(\ln N\frac{I_1}{I_2}\right)^2}{1+\ln N\frac{I_1}{I_2}} \tag{18}$$

According to the condition for establishing the equation (7) or (13), $N\cdot I_1/I_2>1$ must be satisfied. Therefore, $\ln N\cdot I_1/I_2>0$, and the equation (18) must have a positive value. Then, $$1-\ln N\cdot\frac{I_1}{I_2}<\frac{1}{1+\ln N\frac{I_1}{I_2}}$$

and the value of $\partial V_{OUT}/\partial I_3$ in the equation (16) is smaller than the value of $\partial V_{OUT}/\partial I_3$ in the equation (17). That is, in the circuit of the first embodiment, even when a load current is changed, an output voltage can be stabler than that of the conventional circuit.

Figure 6:
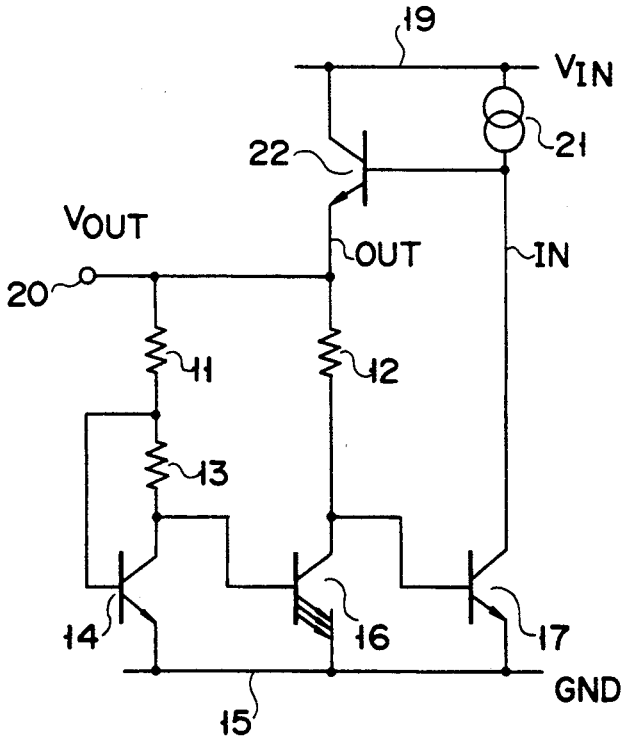
Figure 7:
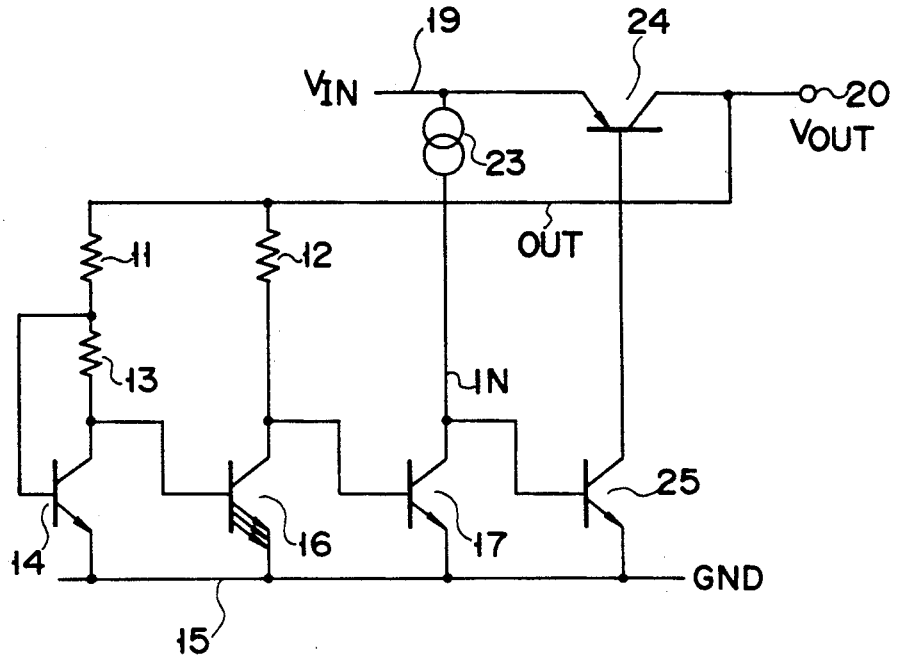
Figure 8:
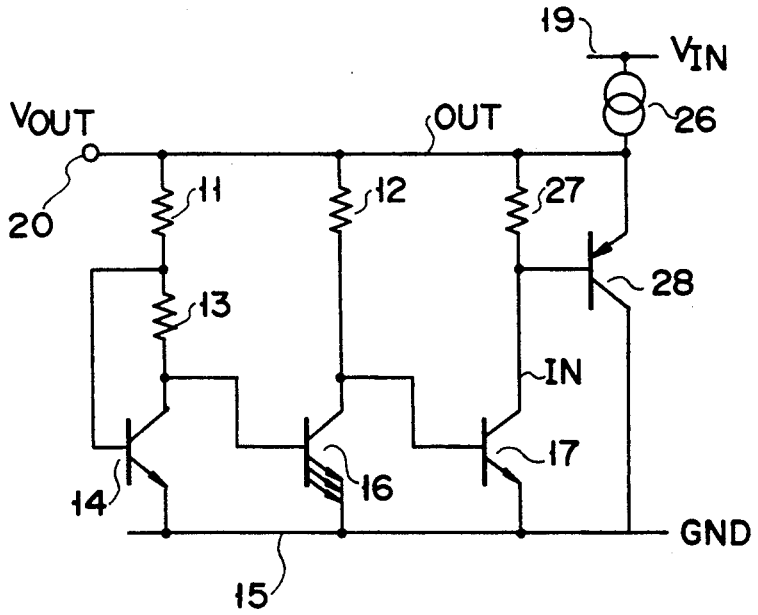

FIGS. 6 to 8 are circuit diagrams showing constant voltage circuits according to the second to fourth embodiments of the present invention wherein various control circuits are used as the control circuits 10.

In the second embodiment shown in FIG. 6, a circuit consisting of a constant current source 21 and an npn transistor 22 is used as a control circuit 10. That is, one terminal of the constant current source 21 is connected to a node 19 of an input voltage $V_{IN}$, and the other terminal of the constant current source 21 is commonly connected to the collector of a transistor 17 and the base of the transistor 22. The collector of the transistor 22 is connected to the node 19, and the emitter of the transistor 22 is connected to an output node for obtaining an output voltage.

In the third embodiment shown in FIG. 7, a circuit consisting of a pnp transistor 24 and an npn transistor 25 is used as a control circuit 10. That is, one terminal of the constant current source 23 is connected to a node 19 of an input voltage $V_{IN}$, and the other terminal of the constant current source 23 is commonly connected to the collector of a transistor 17 and the base of the transistor 25. The emitter of the transistor 24 is connected to the node 19, and the collector and of the transistor 24 is connected to output node 20 and the base of transistor 24 is connected to the collector of the transistor 25, respectively.

In the fourth embodiment shown in FIG. 8, a circuit consisting of a constant current source 26, a resistor 27, and a pnp transistor 28 is used as a control circuit 10. That is, one terminal of the constant current source 26 is connected to a node 19 of an input voltage $V_{IN}$, and the other terminal of the constant current source 26 is connected to an output node 20. One terminal of the resistor 27 is connected to the output node 20, and the other terminal of the resistor 27 is commonly connected to the collector of a transistor 17 and the base of the transistor 28. The emitter of the transistor 28 is connected to the output node 20, and the collector of the transistor 28 is connected to a node 15 having a ground potential.

Figure 9:
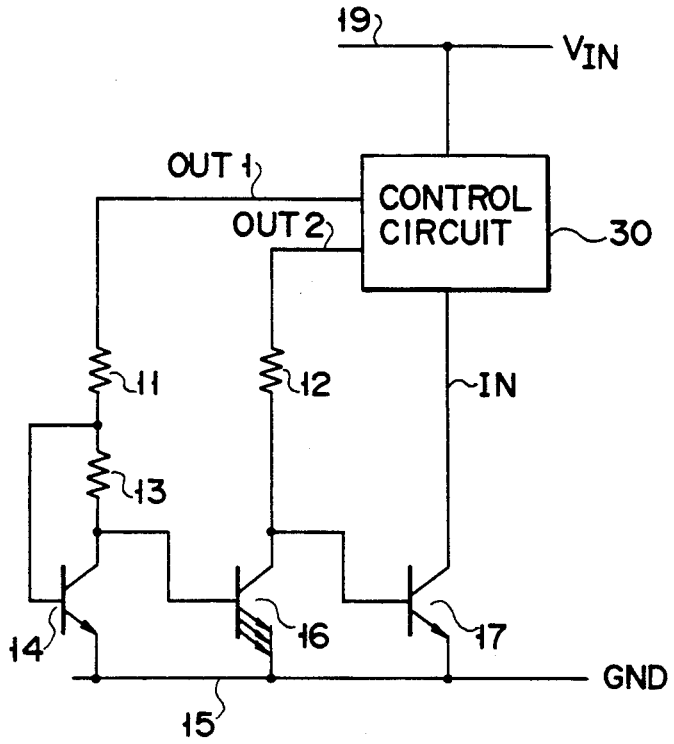
FIG. 9 is a circuit diagram showing another basic circuit arrangement of a constant voltage circuit of the present invention.

FIG. 9 is a circuit diagram showing another basic circuit arrangement of the constant voltage circuit of the present invention. In the above second to fourth embodiments of the present invention shown in FIGS. 6 to 8, the control circuit having one input terminal IN and one output terminal OUT is disclosed. However, in the basic circuit in FIG. 9, a control circuit 30 has two independent output terminals OUT1 and OUT2 for outputting independent output signals in response to a signal input to one input terminal IN. With the above arrangement, the following advantages can be obtained. That is, (1) since the voltages $V_{OUT1}$ and $V_{OUT2}$ of the output terminals OUT1 and OUT2 can be arbitrarily set, a margin of design of the resistors 11 and 12 can be increased; (2) since the two output terminals OUT1 and OUT2 can be obtained, the outputs can be used as two independent reference voltages which do not interfere with each other; and (3) the number of elements can be extremely reduced in a circuit requiring several reference voltage sources.

Figure 10:
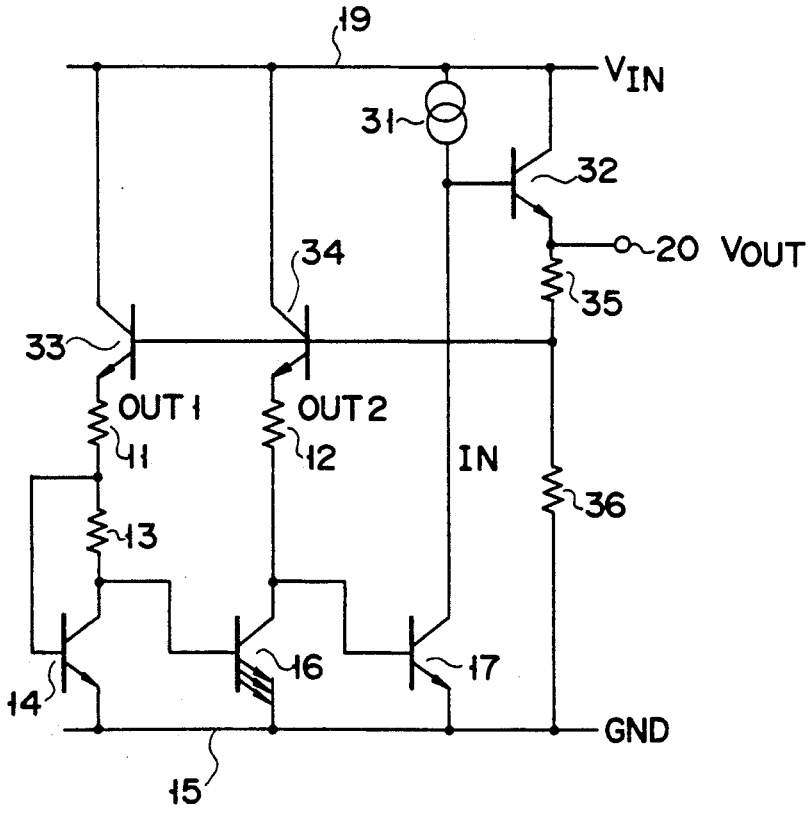
FIG. 10 is a circuit diagram showing an arrangement of a constant voltage circuit according to the fifth embodiment of the present invention.

FIG. 10 is a circuit diagram showing a constant voltage circuit according to the fifth embodiment of the present invention. In the embodiment, the control circuit 30 consists of a constant current source 31, npn transistors 32, 33, and 34, and two resistors 35 and 36. One terminal of the constant current source 31 is connected to a node 19 of an input voltage $V_{IN}$, and the other terminal of the constant current source 31 is connected to the collector of a transistor 17 as an input terminal IN. The collector of the transistor 32 is connected to the node 19, and the base and emitter of the transistor 32 are connected to the other terminal of the constant current source 31 and the output node 20, respectively. One terminal of the resistor 35 is connected to the output node 20, and other terminal is connected to one terminal of the resistor 36. The other terminal of the resistor 36 is connected to the node 15. The collectors of the two transistors 33 and 34 are commonly connected to the node 19 of a power source $V_{IN}$, the bases of the transistors 33 and 34 are commonly connected to a connecting point between the resistors 35 and 36, and each of the emitters of the transistors 33 and 34 is connected to one terminal of a corresponding one of the resistors 11 and 12 as the output terminal OUT1 or OUT2.

In the fifth embodiment with the above arrangement, a current having a value corresponding to an input current is supplied from the output terminal OUT1 or OUT2 to the resistor 11 or 12.

Figure 1:
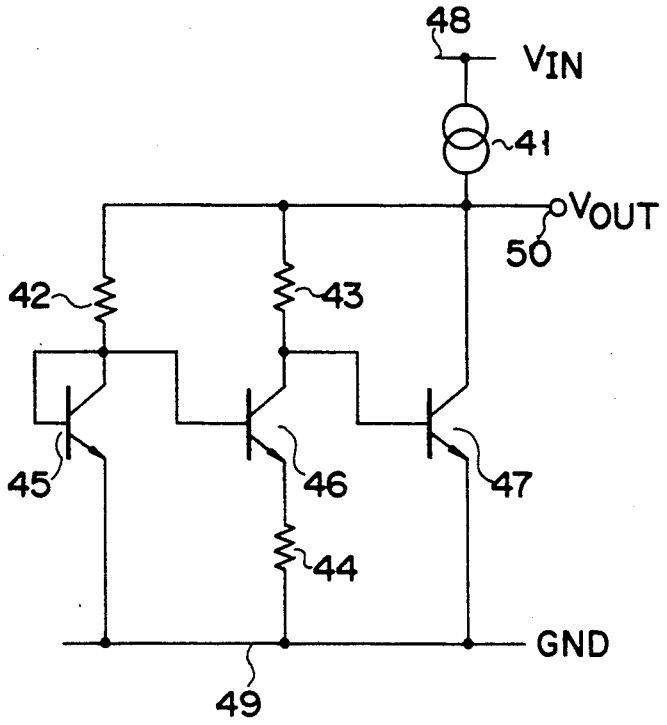
FIG. 1 PRIOR ART
FIG. 1 is a circuit diagram showing an arrangement of a conventional constant voltage circuit.
Figure 2:
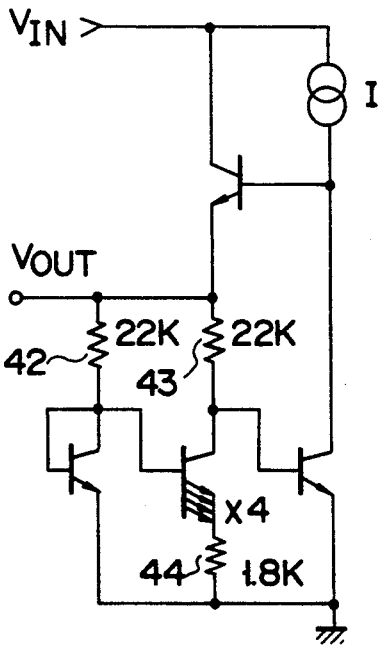
FIG. 2 PRIOR ART
FIG. 2 is a circuit diagram showing a conventional constant voltage circuit in which practical values are set.
Figure 3:
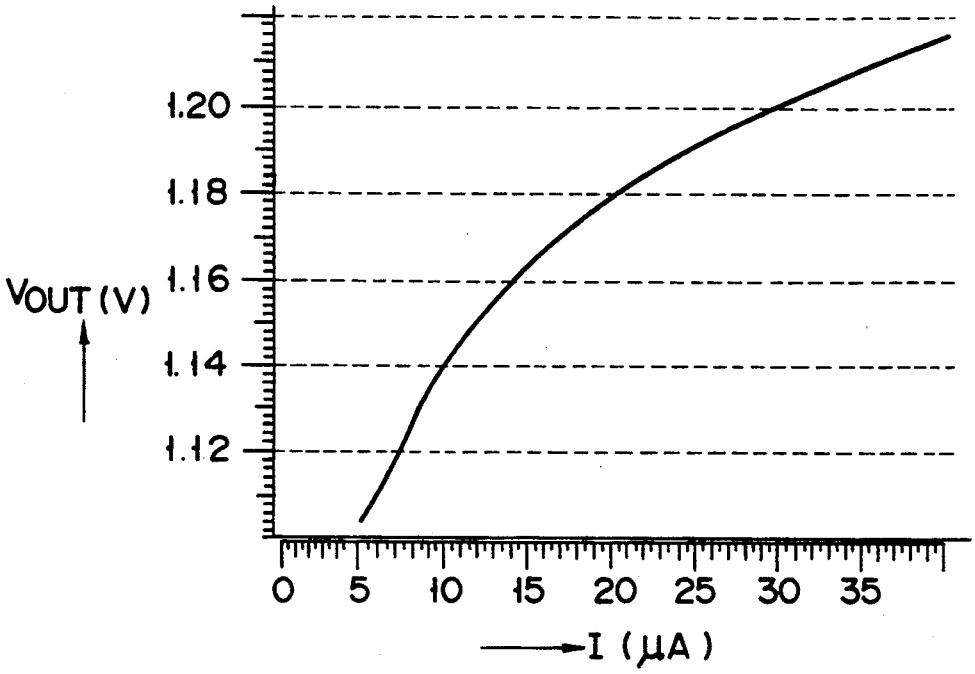
F I G. 3 PRIOR ART
FIG. 3 is a graph showing a value obtained by performing SPICE analysis of the constant voltage circuit in FIG. 2.
Figure 11:
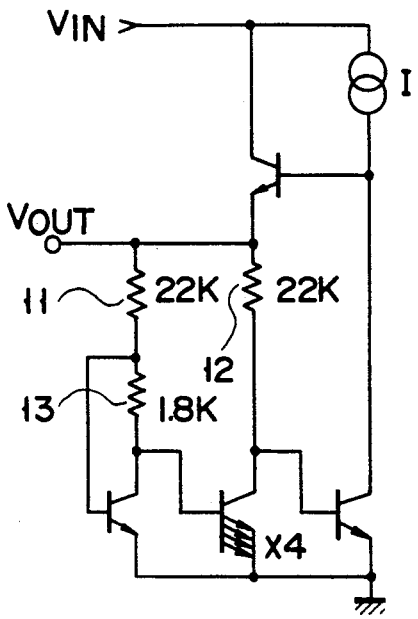
FIG. 11 is a circuit diagram showing a constant voltage circuit in which practical values are set according to an embodiment of the present invention.
Figure 12:
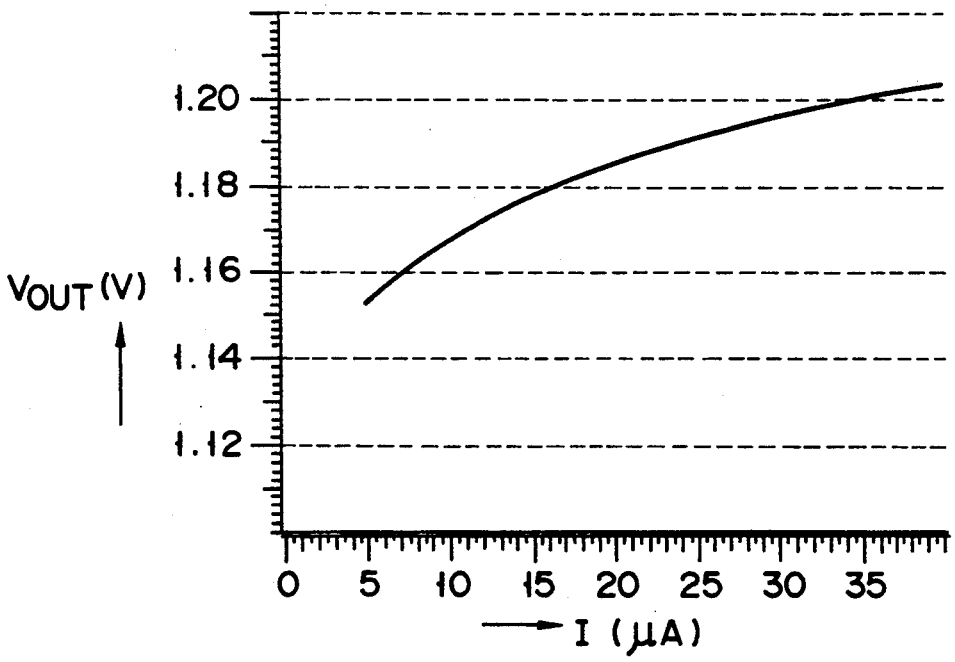
FIG. 12 is a graph showing a value obtained by performing SPICE analysis of the constant voltage circuit shown in FIG. 11.

Stability of the output voltage in the circuit according to each embodiment described above will be described below. FIG. 12 is a graph showing change characteristics of the output voltage $V_{OUT}$ obtained by performing SPICE analysis when a value I of a current source is changed in a circuit with the arrangement in FIG. 10 (corresponding to the circuit according to the second embodiment in FIG. 6). In this case, as shown in FIG. 11, the resistors 11, 12, and 13 are respectively set to have the resistance 22 KΩ, 22 KΩ, and 1.8 KΩ, an emitter area ratio N of the transistor 14 to the transistor 16 is set to be 4. As is apparent from FIG. 12, when the current value was changed from 10 μA to 30 μA, an output voltage difference in the circuit of this embodiment was 27.4 mV. Therefore, in the circuits according to the above embodiments of the present invention, a stable output voltage can be obtained compared with the output voltage difference of 60.2 mV obtained from the conventional circuit shown in FIG. 3.

Note that the present invention is not limited to the above embodiments, and various modifications may be made. For example, in the above circuits according to the embodiments, although a control circuit having input and output terminals to output a current having a value corresponding to a current supplied to the input terminal is described, a control circuit for outputting a voltage having a value corresponding to a current supplied to the input terminal may be used.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A constant voltage circuit comprising:

a control circuit having input and output terminals in which an output at said output terminal is controlled according to a current at said input terminal;

a first resistor element having a first terminal connected to said output terminal of said control circuit;

a second resistor element having a first terminal connected to a second terminal of said first resistor element;

a first transistor of a first polarity having a base connected to said second terminal of said first resistor element, a collector connected to a second terminal of said second resistor element, and an emitter connected to a first node;

a third resistor element having a first terminal connected to said output terminal of said control circuit;

a second transistor of the first polarity having a collector connected to a second terminal of said third resistor element, a base connected to said second terminal of said second resistor element, and an emitter connected to said first node; and a third transistor of the first polarity having a collector connected to said input terminal of said control circuit, a base connected to said second terminal of said third resistor element, and an emitter connected to said first node;

said control circuit including:

a current source having a first terminal connected to a second node having a predetermined potential applied thereto and a second terminal connected to said collector of said third transistor, a fifth transistor of a second polarity having an emitter connected to said second node and a collector connected to said first terminal of said first resistor element, to said first terminal of said third resistor element and to a third node at which an output voltage is provided, and a sixth transistor of the first polarity having a collector connected to a base of said fifth transistor, a base connected to said collector of said third transistor, and an emitter connected to said first node.

2. A circuit according to claim 1, wherein said first transistor has a different current density than said second transistor.

3. A constant voltage circuit comprising:

a control circuit having an input terminal and first and second output terminals in which an output at said first and second output terminals is controlled according to a current at said input terminal, said control circuit further having a terminal connected to a second node having a predetermined potential applied thereto;

a first resistor element having a first terminal connected to said first output terminal of said control circuit;

a second resistor element having a first terminal connected to a second terminal of said first resistor element;

a first transistor of a first polarity having a base connected to said second terminal of said first resistor element, a collector connected to a second terminal of said second resistor element, and an emitter connected to a first node;

a third resistor element having a first terminal connected to said second output terminal of said control circuit;

a second transistor of the first polarity having a collector connected to a second terminal of said third resistor element, a base connected to said second terminal of said second resistor element, and an emitter connected to said first node; and a third transistor of the first polarity having a collector connected to said input terminal of said control circuit, a base connected to said second terminal of said third resistor element, and an emitter connected to said first node.

4. A circuit according to claim 3, wherein said first and second transistors have different emitter areas to cause the current flowing through said first and second transistors to have different current densities.

5. A circuit according to claim 3, wherein said first and third resistor elements have different resistances to cause the currents flowing through said first and second transistors to have different current densities.

6. A circuit according to claim 3, wherein said control circuit includes:

a fourth transistor of the first polarity having a collector connected to said second node and an emitter connected to said first terminal of said first resistor element, a fifth transistor of the first polarity having a collector connected to said second node and an emitter connected to said first terminal of said third resistor element, a current source having a first terminal connected to said second node and a second terminal connected to said collector of said third transistor, a sixth transistor of the first polarity having a collector connected to said second node, a base connected to said second terminal of said current source, and an emitter connected to a third node at which an output voltage is provided, a fourth resistor element having a first terminal connected to said third node and a second terminal commonly connected to bases of said fourth and fifth transistors, and a fifth resistor element having a first terminal connected to said second terminal of said fourth resistor element and a second terminal connected to said first node.

7. A circuit according to claim 3, wherein said first transistor has a different current density than said second transistor.

* * * * *